US008669031B2

(12) United States Patent
Sakimura et al.

(10) Patent No.: US 8,669,031 B2
(45) Date of Patent: Mar. 11, 2014

(54) ELECTROPHOTOGRAPHIC PHOTORECEPTOR AND IMAGE FORMING METHOD

(75) Inventors: Tomoo Sakimura, Tokyo (JP); Shinchi Hamaguchi, Tokyo (JP); Naoki Nozaki, Tokyo (JP); Hisashi Nozaki, legal representative, Saitama (JP); Toshiko Nozaki, legal representative, Saitama (JP); Mayuko Matsusaki, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 43 days.

(21) Appl. No.: 13/151,807

(22) Filed: Jun. 2, 2011

(65) Prior Publication Data

US 2011/0311907 A1 Dec. 22, 2011

(30) Foreign Application Priority Data

Jun. 18, 2010 (JP) ..... 2010-139122

(51) Int. Cl.
*G03G 15/04* (2006.01)

(52) U.S. Cl.
USPC ..... 430/69; 430/56; 430/60

(58) Field of Classification Search
USPC ..... 430/56, 60, 69
See application file for complete search history.

(56) References Cited

U.S. PATENT DOCUMENTS

| | | | | |
|---|---|---|---|---|
| 7,335,452 | B2 * | 2/2008 | Perry et al. | 430/69 |
| 7,361,439 | B2 * | 4/2008 | Wilbert et al. | 430/65 |
| 2011/0217641 | A1 * | 9/2011 | Sakimura et al. | 430/56 |

FOREIGN PATENT DOCUMENTS

| | | |
|---|---|---|
| JP | 2001-235885 | 8/2001 |
| JP | 2003-173037 | 6/2003 |
| JP | 2003-302777 | 10/2003 |
| JP | 3480618 | 10/2003 |

* cited by examiner

*Primary Examiner* — Stewart Fraser
(74) *Attorney, Agent, or Firm* — Lucas & Mercanti, LLP

(57) ABSTRACT

Reduced are interferential streaks in a halftone image, which are produced when using a cylindrical photoreceptor conductive substrate having been subjected to tool bit cutting processing, and provided are an electrophotographic photoreceptor capable of obtaining high image quality in response to a light printing field or the like and an image forming method employing the electrophotographic photoreceptor. Disclosed is an electrophotographic photoreceptor possessing a cylindrical substrate having been finished via cutting processing and provided thereon, a photosensitive layer, wherein among peaks other than at a lag of 0 in a correlogram of a substrate surface profile in a direction along a central axis of the substrate, a mean value from a maximum peak in height to a third peak in height is 0.3-0.8, each of the peaks in height corresponding to an autocorrelation coefficient.

5 Claims, 4 Drawing Sheets

ELECTROPHOTOGRAPHIC PHOTORECEPTOR AND IMAGE FORMING METHOD

This application claims priority from Japanese Patent Application No. 2010-139122 filed on Jun. 18, 2010, which is incorporated hereinto by reference.

TECHNICAL FIELD

The present invention relates to an electrophotographic photoreceptor (also referred to simply as a photoreceptor) and an image forming method applicable for forming an image having very high image quality in the light printing field or the like.

BACKGROUND

In recent years, images in a printing system accompanied with a dry electrophotographic system have been improved, and it has been utilized in a printing field for the comparatively small number of print copies. As a result, a desired image level is raised to such an extent that we have not conventionally understood it, and rare usage in the past, for example, printing onto a coated paper sheet, printing for high coverage images, printing for extremely high quality images and images exhibiting subtle tone (color tone), printing continuously for a large number of the same images, or the like has been in heavy usage. Thus, generation of failures which have not been mentioned at all is increased.

There appears one problem such as generation of interferential streaks in a halftone image seemingly originated by light exposure pattern and cutting cycle on the support surface of a photoreceptor. This is a problem which has been recurrently produced in recent years via combination of demand of improving evenness of intermediate color, performance improvement of image forming apparatuses and application for coated paper sheets, and as regards this problem, a quick measure is desired (refer to Patent Documents 1-4, for example).

As to those prior arts, cutting conditions are adjusted, and blast processing and anidization after cutting processing are conducted, but since cutting periodicity itself remains in the case of conventional adjustment techniques, image quality to be highly demanded has still been insufficient, and not only there appears risk for the development of image defects caused by digging-in of a medium and generation of pin holes in the case of the blast processing or the anodization, but also productivity in substrate processing becomes low. Thus, further improvement thereof is demanded.

Patent Document 1: Japanese Patent Open to Public Inspection (O.P.I.) Publication No. 2003-302777

Patent Document 2: Japanese Patent No. 3480618

Patent Document 3: Japanese Patent O.P.I. Publication No. 2001-235885

Patent Document 4: Japanese Patent O.P.I. Publication No. 2003-173037

SUMMARY

The present invention has been made to directly reduce the periodicity, and to develop a technique as an effective solution against the above-described problem.

It is an object of the present invention to reduce interferential streaks in a halftone image, which are produced when using a cylindrical photoreceptor conductive substrate (also referred to simply as a substrate or a drawn tube) having been subjected to tool bit cutting processing, and to provide an electrophotographic photoreceptor capable of obtaining high image quality in response to a light printing field or the like and an image forming method employing the electrophotographic photoreceptor.

BRIEF DESCRIPTION OF THE DRAWINGS

Embodiments will now be described, by way of example only, with reference to the accompanying drawings which are meant to be exemplary, not limiting, and wherein like elements numbered alike in several figures, in which.

DESCRIPTION OF THE PREFERRED EMBODIMENTS

The object of the present invention is accomplished by the following structures.

(Structure 1) An electrophotographic photoreceptor comprising a cylindrical substrate having been finished via cutting processing and provided thereon, a photosensitive layer, wherein among peaks other than at a lag of 0 in a correlogram of a surface profile of the substrate in a direction along a central axis of the substrate, a mean value from a maximum peak in height to a third peak in height is 0.3-0.8, each of the peaks in height corresponding to an autocorrelation coefficient.

(Structure 2) The electrophotographic photoreceptor of Structure 1, wherein positions R1, R2, R3, - - - of peaks in the correlogram exhibit no arithmetic sequence, where the positions of peaks each peak having 0.3 or more are designated in order from the smallest lag.

(Structure 3) An image forming method comprising the step of exposing the electrophotographic photoreceptor of Structure 1 or 2 to laser light or LED light to form images.

While the preferred embodiments of the present invention have been described using specific terms, such description is for illustrative purposes only, and it is to be understood that changes and variations may be made without departing from the spirit or scope of the appended claims.

DETAILED DESCRIPTION OF THE INVENTION

The present invention will be further described.

Figure 1:
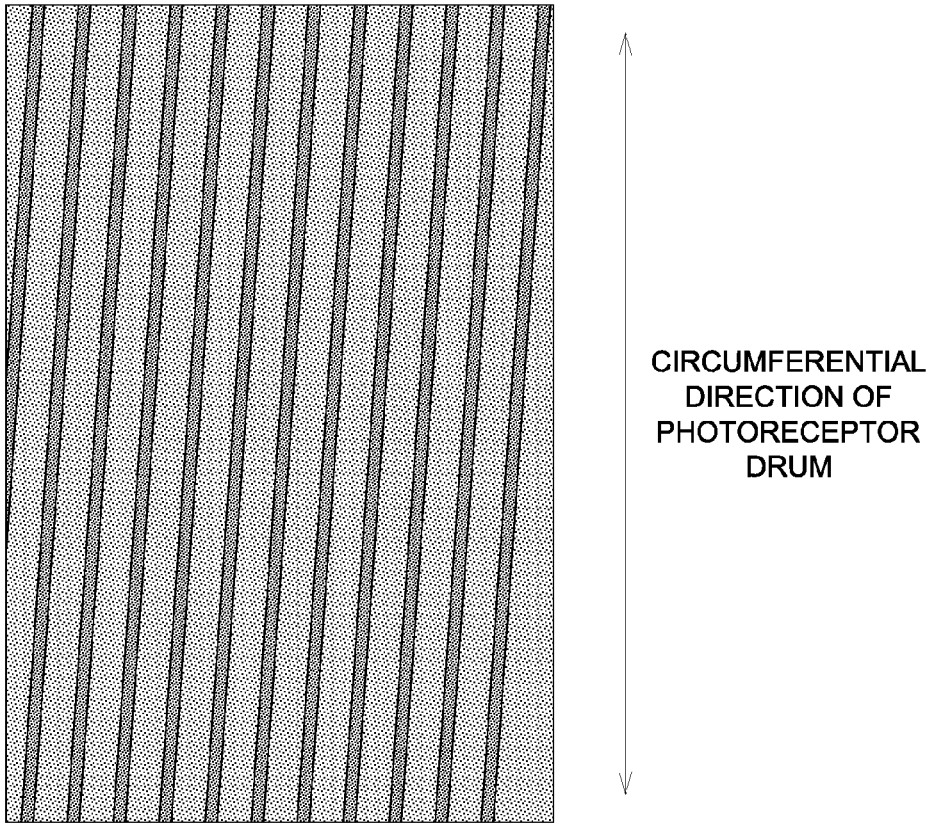
FIG. 1 is a schematic diagram showing streak-shaped density unevenness appearing on the final picture plane as a problem in the present invention.

Failures seen as a problem in the present invention are caused by a phenomenon in which diagonal streak-shaped density unevenness is produced on an image as shown in FIG. 1, and it is noticeable in a uniform image. It is specifically seen as a problem in a smooth surface image as well as in a large-sized high quality image as seen in light printing.

According to studies done by the inventors, the cause of generating interferential streaks seen as a problem in the present invention is as follows.

Figure 2:
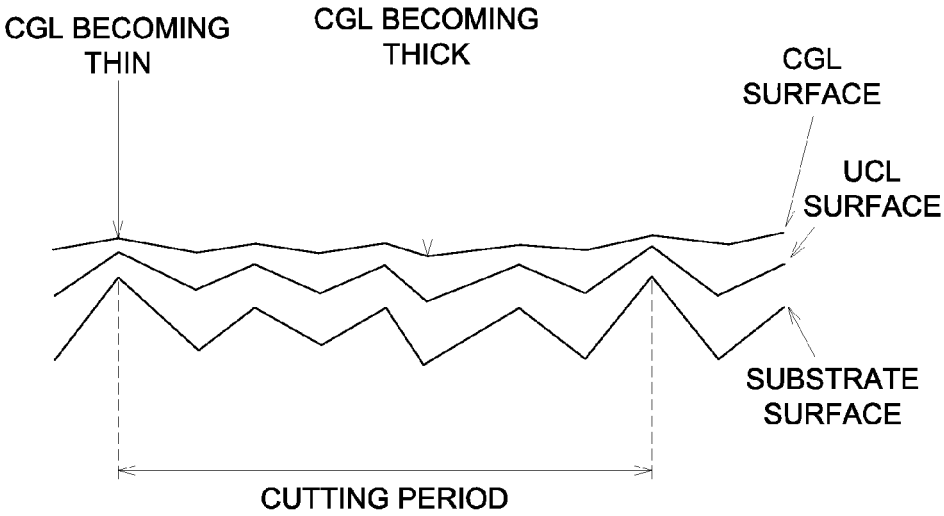
FIG. 2 is a schematic diagram showing film thickness variation of a charge generation layer caused by cutting pitch on the surface of a conductive substrate.

The interferential streaks are produced by superimposing periodicity in sensitivity variation of a photoreceptor and periodicity of light exposure. Since a coating amount of a charge generation layer (CGL) coating solution is reflected by the underlayer profile as shown in FIG. 2, layer thickness of the charge generation layer is periodically varied when there appears periodicity in surface profile on the substrate, whereby sensitivity is periodically varied. When such a photoreceptor is periodically exposed to laser light, light emitted from a LED light source or the like, streak-shaped density unevenness is produced via interference of both sensitivity and light exposure which are varied. As the appearance of interferential unevenness, density unevenness extended in the slightly oblique direction is to be observed.

Therefore, with respect to reduction of interferential streaks, since it is effective to reduce periodicity on the conductive substrate, it is effective to reduce periodicity of the substrate profile in the main scanning direction. In the present invention, the reduction range of periodicity which is effective to reduce interferential streaks has been studied, and identified in quantitative terms.

An autocorrelation coefficient of the present invention is 0.3-0.8, but the reason is because when the surface is roughened via cutting processing so as to be less than 0.3, large variation points are partially produced, whereby image flaws are easily produced (because sharp flaws extended in the circumferential direction and variation in surface profile are presumably too large in places), and when the surface is roughened via cutting processing so as to be 0.8 or more, the effect of reducing interferential streaks is to be insufficient.

The autocorrelation coefficient has a large peak because of lag (after-mentioned) at transfer pitch intervals since the substrate surface processed at constant transfer speed becomes the processed surface corresponding to the transfer pitch, and the mean value of from the maximum peak in height to the third peak in height (provided that the after-mentioned 1 is excluded) is higher than 0.8. On the other hand, in the case of blast processing by which a medium is crushed at random as well as anodization by which the surface is chemically roughened, a high peak is hardly produced, resulting in appearance of 0.3 or less. However, such a surface profile produces the prevention effect, though the effect of reducing interferential streaks is insufficient, but a problem other than the foregoing is to be caused. Therefore, in order to achieve an object of the present invention, the autocorrelation coefficient is required to be 0.3-0.8. A preferred method to achieve the present invention can be realized by accelerating or decelerating the tool bit transfer speed in the appropriate range, or varying the rotating speed in the appropriate range.

Practically, cutting is conducted while varying the tool bit transfer speed, the number of revolutions of a conductive substrate to be subjected to cutting, or both of them. When taking into account shape precision (runout or the like) of the conductive substrate per se, cutting carried out while varying the tool bit transfer speed is most effective.

In addition, it is not to say that there is no patent application in which the relation between a conductive substrate of a photoreceptor and an autocorrelation coefficient has been studied. However, an insufficient effect is produced since they seek considerably harmless periodicity, or a harmful risk is possessed though the effect is sufficient because of low periodicity. The invention disclosed in Japanese Patent O.P.I. Publication No. 2009-92821 aims at inhibiting density unevenness, transfer failure and lack of line image by specifying the surface profile inside the cutting transfer pitch on the substrate having been cut at constant speed employing an autocorrelation function, and specifying surface roughness on the surface of a photosensitive layer in addition to a binder resin in the outermost surface layer of the photosensitive layer. As to the invention disclosed in each of Japanese Patent O.P.I. Publication No. 2003-302777, Japanese Patent O.P.I. Publication No. 2003-149844 and Japanese Patent O.P.I. Publication No. 2003-173037, attention is focused on the relation between an interference fringe and the autocorrelation coefficient, but it is one in which shape in cutting pitch is adjusted at constant cutting speed, or a process at high cost and in troublesome chores such as an anodized film formation process after cutting processing is additionally provided. Thus, the prior art is not one in which an autocorrelation coefficient at a cutting pitch to mainly cause streaks is used in cases where finishing is conducted via cutting processing at high productivity as seen in the present invention.

It is mainly intended in the present invention to find out that it is very effective to reduction of interferential streak failure to disarrange periodical concavo-convex regularity, caused by cutting, on the surface of a cylindrical conductive substrate, and further to have found out that it is most appropriate that the level of the disarrangement is represented by an autocorrelation coefficient and to have found out its upper limit value and lower limit value.

In the case of cutting processing, since a cutting tool bit is brought into contact with the surface while rotating a substrate as a central axis, the cylindrical conductive substrate of the photoreceptor is easy to be in the form of a processing surface profile regularly formed in the direction along a central axis thereof. In order to make the above-described autocorrelation coefficient to fall within the range of 0.3-0.8, the processing periodicity width should be changed when shaping the substrate surface via cutting processing. For this reason, the tool bit transfer speed is changed during processing, or the like. Since the speed is continuously changed during cutting processing, the speed is naturally varied even before reaching the targeted speed, whereby this affects controlling of an autocorrelation coefficient. Further, similarly, it is also possible to be realized by changing revolutions of the conductive substrate during processing. The autocorrelation coefficient is varied by changing the rotating speed of the rotating body, even though ordering variation of the similar tool bit speed. The foregoing reason is presumably because the different number of revolutions during change of the tool bit speed rotational unevenness (wow) caused by different rotating speed affects the autocorrelation coefficient.

(Calculation Method of Autocorrelation Coefficient)

Figure 3A:
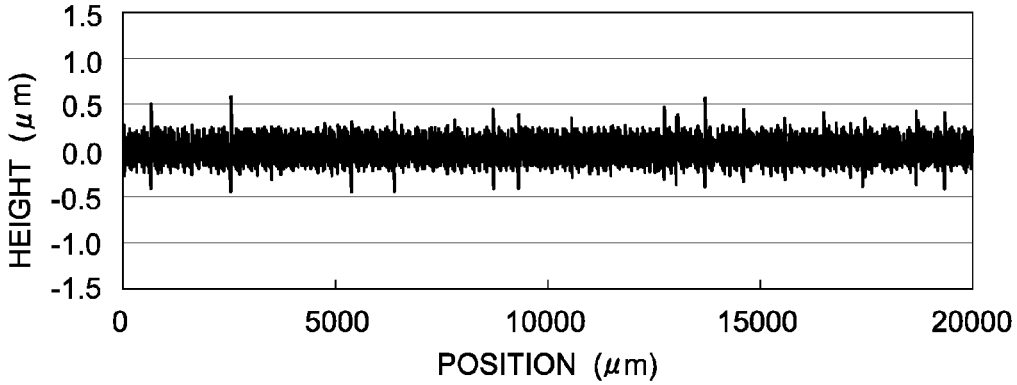
FIGS. 3A and 3B each are a diagram to explain how to calculate an autocorrelation coefficient in the present invention.
Figure 3B:
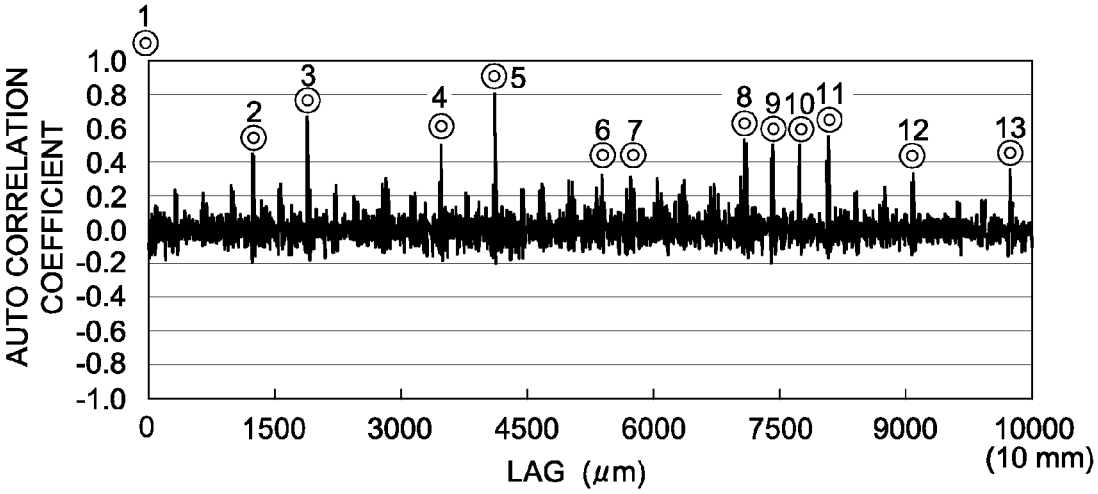

A correlogram of a surface profile in the central axis direction of a cylindrical conductive substrate within an image region in the present invention can be obtained from the processing surface roughness curve as shown in FIGS. 3A, 3B, and Table 1.

TABLE 1

| | Peak 1 | Peak 2 | Peak 3 | Peak 4 | Peak 5 | Peak 6 | Peak 7 | Peak 8 | Peak 9 | Peak 10 | Peak 11 | Peak 12 | Peak 13 |
|---|---|---|---|---|---|---|---|---|---|---|---|---|---|
| Lag Rn (mm) | 0.00 | 1.27 | 1.89 | 3.49 | 4.08 | 5.42 | 5.73 | 7.12 | 7.43 | 8.05 | 8.05 | 9.02 | 9.92 |

TABLE 1-continued

| | Peak 1 | Peak 2 | Peak 3 | Peak 4 | Peak 5 | Peak 6 | Peak 7 | Peak 8 | Peak 9 | Peak 10 | Peak 11 | Peak 12 | Peak 13 |
|---|---|---|---|---|---|---|---|---|---|---|---|---|---|
| *1 | 1.00 | 0.45 | 0.66 | 0.50 | 0.80 | 0.32 | 0.31 | 0.52 | 0.50 | 0.50 | 0.55 | 0.33 | 0.35 |
| Rn/R2 | 0.0 | 1.0 | 1.5 | 2.7 | 3.2 | 4.3 | 4.5 | 5.6 | 5.8 | 6.3 | 6.3 | 7.1 | 7.8 |
| Rn/(R2/2) | 0.0 | 2.0 | 3.0 | 5.5 | 6.4 | 8.5 | 9.0 | 11.2 | 11.7 | 12.7 | 12.7 | 14.2 | 15.6 |

*1: Autocorrelation coefficient

FIG. 3A shows a processing surface roughness curve at a measured length of 20 mm, but it is composed of equally-spaced 32679 height data (−0.084 μm, −0.028 μm, −0.026 μm, −0.064 μm, - - - ).

FIG. 3B shows a correlogram prepared by taking 1 mm at the forefront (for 1634 data as the number of data) as a base zone in the foregoing height data. In addition, the correlogram is one obtained by plotting results from which an autocorrelation coefficient between the part of a certain observation result (base zone) and a target zone having the same number of data as in the base zone is calculated, while displacing the target zone, and the displacing amount in the target zone (lag; calculation made up to 10 mm herein) and the autocorrelation coefficient are plotted on the horizontal axis and the vertical axis, respectively. A correlation coefficient is, when there is the same number of two numerical sequence data, a value obtained by dividing a mean-value of the covariance with the product of each standard deviation, and a correlation coefficient calculated among the partial data within certain numerical sequence data is called an autocorrelation coefficient. The autocorrelation coefficient is 1 when the base zone coincides with the target zone, is −1 when the absolute value of each of the two is equal to each other, and "positive" and "negative" thereof are reversed, and approaches 0 when similarity between the two is lower.

Table 1 is a table in which peak positions (Rn) each having 0.3 or more, (lag), and values (autocorrelation coefficient) are shown.

The mean-value of peaks in size from the maximum (provided that 1 is excluded) to the third is (0.66+0.80+0.55)/3=0.67, and values of Rn are 0.00, 1.27, 1.87, - - - , and 9.92, showing no arithmetic sequence. In addition, "arithmetic sequence" means numerical sequence having approximately identical difference between the adjacent terms, and specifically, at least one half of values of Rn/R2 or Rn/(R2/2) in consideration of the case of data defects is arranged to be 0, 1, or 9 as the first decimal place when rounding off the second decimal place. in the case of Table 1, when being divided by R2 (1.27) or R2/2 (1.27/2), those in which the first decimal place does not show 0, 1 or 9 when rounding off the second decimal place are the following 8 such as R4, R5, R6, R8, R9, R10, R11 and R13 among the following 11 such as R3, R4, R5, R6, R7, R8, R9, R10, R11, R12 and R13, showing no arithmetic sequence because of appearance of not less than one half thereof. The arithmetic sequence appears when tool bit transfer speed remains constant, or high regularity has been achieved.

As to the measured length of the processing surface, the length in which at least 20 periods are readable is preferable, and the length in which at least 30 periods are readable is more preferable.

As the measuring portion, for example, the central portion in the axis direction of a cylindrical substrate is selected, and as the measured length, for example, an approximate length of 20 mm is selected.

The autocorrelation coefficient is a value in which 1634 as the number of data in 1 mm are calculated at a measured length of 20 mm, and a base interval of 1 mm, as described above. Further, as to measurements of the cross-sectional surface curve or the roughness curve, processing period may be read out from each curve, and the present invention is not limited thereto, but stylus surface roughness measuring device, a non-contact type surface analyzer employing laser or the like is usable.

As an example employing the stylus surface roughness measuring device, the following conditions are used.

Measuring device: SURFCOM 1400D, manufactured by Tokyo Seimitsu Co., Ltd.

Measuring mode: Roughness measurement (JIS'01 Standard)

Length to be measured: 20.0 mm

Cut-off: 0.08 mm (Gaussian)

Measuring speed: 0.15 mm/sec

[Structure of Photoreceptor]

Next, the structure of the foregoing photoreceptor will be described.

In the present invention, the photoreceptor means an electrophotographic photoreceptor in which at least one function of indispensable charge generation and charge transport functions is provided in an organic compound for the structure of the electrophotographic photoreceptor, and in many cases, is a so-called organic photoreceptor containing commonly known organic charge generation material or organic charge transport material. In addition, since all of commonly known photoreceptors such as a photoreceptor formed from a polymeric complex for the charge generation function and the charge transport function, and so forth are included, in the case of the following description, it is often referred to also as an organic photoreceptor.

The organic photoreceptor of the present invention possesses at least a photosensitive layer provided on a conductive support, or possesses a protective layer further provided in order on the photosensitive layer, but the following layer structures can be specifically exemplified.

(1) A layer structure in which an intermediate layer, a charge generation layer and a charge transport layer as photosensitive layers, and a protective layer are laminated in order on a conductive substrate (2) Another layer structure in which an intermediate layer, a single layer containing a charge transport material and a charge generation material as a photosensitive layer, and a protective layer are laminated in order on a conductive substrate The layer structure of an organic photoreceptor and utilized compounds in the present invention in relation to the above-described (1) will be mainly described below.

(Conductive Substrate)

The conductive substrate to be used in the present invention (referred to also as a conductive support) is a cylindrical support exhibiting conductivity, and may be any support as long as the cylindrical support exhibits a processing profile regularly formed along a central axis, provided on a circumferential surface of the cylindrical support via cutting. Examples thereof include those in the form of a drum which are formed of a metal such as aluminum, copper, chromium, nickel, zinc, stainless steel or the like.

[Intermediate Layer]

In the present invention, an intermediate layer having a bather function and an adhesion function can be provided between a conductive layer and a photosensitive layer. When considering various failure protections and so forth, a structure in which an intermediate layer is provided is preferable.

The intermediate layer can be formed via dip coating while drying or the like by dissolving a binder resin such as casein, polyvinyl alcohol, nitrocellulose, an ethylene acrylic acid copolymer, polyamide, polyurethane, alkyd-melamine, epoxy or the like in a commonly known solvent. Of these, an alcohol-soluble polyamide resin is preferable.

Further, various kinds of particles (metal oxide particles and so forth) can be contained for the purpose of adjusting resistance of the intermediate layer, and providing surface roughness thereof. Examples of the metal oxide particles include alumina particles, zinc oxide particles, titanium oxide particles, tin oxide particles, antimony oxide particles, indium oxide particles, bismuth oxide particles and so forth. Particles formed of indium oxide in which tin is doped, tin oxide or zirconium oxide in which antimony is doped, or the like are usable.

These particles may be used singly or in combination with at least two kinds as a mixture. When at least two kinds are mixed, configuration of solid solution or fusion may be taken. Such a particle preferably has an average particle diameter of 0.3 μm or less, and more preferably has an average particle diameter of 0.1 μm or less. Further, these particles may be subjected to a single surface treatment or plural surface treatments with an inorganic compound or an organic compound.

As a solvent used in an intermediate layer, the commonly known are usable, but when alcohol-soluble polyamide is used for a binder, alcohols having 1-4 carbon atoms, such as methanol, ethanol, n-propyl alcohol, isopropyl alcohol, n-butanol, t-butanol and sec-butanol are preferable in view of excellent solubility and coatability of polyamide. Further, in order to improve solution coatability and a storage property, dispersibility of particles and film formation, an auxiliary solvent may be used in combination with the foregoing solvent. Examples of the auxiliary solvent capable of obtaining excellent effects include methanol, benzyl alcohol, toluene, methylene chloride, cyclohexane, tetrahydrofuran and so forth.

The density of a binder resin is appropriately selected depending on layer thickness of an intermediate layer and a production speed.

As a mixture ratio of inorganic particles to a binder resin during dispersion of the inorganic particles, 20-400 parts by volume of the inorganic particles with respect to 100 parts by volume of the binder resin are preferable, and 50-200 parts by volume of the inorganic particles with respect to 100 parts by weight of the binder resin are more preferable.

As a means to disperse inorganic particles, an ultrasonic homogenizer, a ball mill, a bead mill, a sand grinder and a homogenizing mixer are usable, but the present invention is not limited thereto.

A method of drying the intermediate layer can be appropriately selected depending on kinds of solvents, binder resins and layer thickness, but thermal drying is preferable.

The intermediate layer preferably has a layer thickness of 0.1-30 μm, and more preferably has a layer thickness of 0.3-15 μm.

In addition, a coating solution for the intermediate layer is capable of avoiding generation of image defects by filtrating foreign matter and an aggregate before coating.

(Charge Generation Layer)

A charge generation layer used in the present invention contains a charge generation material and a binder resin, and is preferably formed by dispersing the charge generation material in a binder resin solution, followed by coating.

Examples of the charge generation material include azo pigments such as Sudan Red and Diane Blue; quinone pigments such as pilene quinone and anthoanthrone; quinocyanine pigments; perylene pigments; indigo pigments such as indigo and thioindigo; and phthalocyanine pigments, but the present invention is not limited thereto. These charge generation materials can be used singly, as a mixture of at least two kinds or a mixed crystal of at least two kinds.

As a binder resin for the charge generation layer, a commonly known resin is usable. Examples thereof include a polystyrene resin, a polyethylene resin, a polypropylene resin, an acrylic resin, a methacrylic resin, a vinyl chloride resin, a vinyl acetate resin, a polyvinyl butyral resin, an epoxy resin, a polyurethane resin, a phenol resin, a polyester resin, an alkyd resin, a polycarbonate resin, a silicone resin, a melamine resin, a copolymer resin containing at least two of these resins (e.g., a vinyl chloride-vinyl acetate copolymer resin, and a vinyl chloride-vinyl acetate-anhydrous maleic acid copolymer resin), a polyvinyl carbazole resin, and so forth, but the present invention is not limited thereto.

As to formation of a charge generation layer, it is preferred that a charge generation material is dispersed in a solution in which a binder resin is dissolved in a solvent employing a dispersing apparatus to prepare a coating solution, the coating solution is coated with a coater so as to give a predetermined thickness, and the coating film is dried to prepare the charge generation layer.

Examples of the solvent for coating after dissolving a binder resin, which is used for the charge generation layer, include toluene, xylene, methylene chloride, 1,2-dichloroethane, methyl ethyl ketone, cyclohexane, ethyl acetate, butyl acetate, methanol, ethanol, propanol, butanol, methyl cellosolve, ethyl cellosolve, tetrahydrazine, 1-dioxane, 1,3-dioxolane, pyridine and diethyl amine, but the present invention is not limited thereto.

Usable examples of a dispersing means for the charge generation material include an ultrasonic homogenizer, a ball mill, a sand grinder, a homogenizing mixer and so forth, but the present invention is not limited thereto.

The mixing ratio of the charge generation material to the binder resin is preferably 1-600 parts by weight with respect to 100 parts by weight of the binder resin, and more preferably 50-500 parts by weight. The layer thickness of the charge generation layer differs depending on properties of the charge generation material, properties of the binder resin, and a mixing ratio thereof, but is preferably 0.01-5 μm, and more preferably 0.05-3 μm. In addition, generation of image defects can be inhibited by filtering foreign matter and aggregates before coating a coating solution for the charge generation layer. The charge generation layer can also be formed via vacuum evaporation of the foregoing pigment.

[Charge Transport Layer]

A charge transport layer used in a photosensitive layer of the present invention contains a charge transport material (CTM) and a binder resin, and is formed via coating after dissolving the charge transport material in a binder resin solution.

Examples of the charge transport material include a carbazole derivative, an oxazole derivative, an oxadiazole derivative, a thiazole derivative, a thiadizole derivative, a triazole derivative, an imidazole derivative, an imidazolone derivative, an imidazolidine derivative, a bisimidazolidine derivative, a styryl compound, a hydrazone compound, a pyrazoline compound, an oxazolone derivative, a benzoimidazole derivative, a quinazoline derivative, a benzofuran derivative, an acridine derivative, a phenazine derivative, an aminostilbene derivative, a triaryl amine derivative, a phenylene diamine derivative, a stilbene derivative, a benzidine derivative, poly-N-vinyl carbazole, poly-1-vinyl pyrene and poly-9-vinyl anthracene, a triphenyl amine derivative and so forth, and these may be used singly, or as a mixture in combination with at least two kinds.

A commonly known resin can be used as a binder resin for the charge transport layer, and examples thereof include a polycarbonate resin, a polyacrylate resin, a polyester resin, a polystyrene resin, a styrene-acrylnitryl copolymer resin, a polymethacrylic acid ester resin, and a styrene-methacrylic acid ester copolymer resin, but polycarbonate is preferable. Further, BPA, BPZ, dimethyl BPA, and a BPA-dimethyl BPA copolymer are preferable in view of crack resistance, wear resistance, and an electrification property.

As to formation of a charge transport layer, it is preferred that a binder resin and a charge transport material are dissolved to prepare a coating solution; the coating solution is coated with a coater so as to give the predetermined layer thickness; and the coating film is dried to prepare charge transport layer.

Examples of the solvent to dissolve the binder resin and the charge transport material include toluene, xylene, methylene chloride, 1,2-dichloroethane, methyl ethyl ketone, cyclohexane, ethyl acetate, butyl acetate, methanol, ethanol, propanol, butanol, tetrahydrofuran, 1,4-dioxane, 1,3-dioxolane, pyridine and diethyl amine, but the present invention is not limited thereto.

The mixing ratio of the charge transport material to the binder resin is preferably 10-500 parts by weight of the charge transport material with respect to 100 parts by weight of the binder resin, and more preferably 20-100 parts by weight of the charge transport material.

The layer thickness of the charge transport layer differs depending on properties of the charge transport material, properties and a mixing ratio of the binder resin, but it is preferably 5-40 μm, and more preferably 10-30 μm.

An antioxidant, an electronic conductive agent and a stabilizer may be added into the charge transport layer. Antioxidants disclosed in Japanese Patent O.P.I. publication No. 2000-305291 may be used, and electronic conductive agents disclosed in Japanese Patent O.P.I. Publication No. 50-137543 and Japanese Patent O.P.I. Publication No. 58-76483 may be used.

In addition, a coating solution for the charge transport layer is capable of avoiding generation of image defects by filtrating foreign matter and an aggregate before coating.

A protective layer may be provided on the outermost surface of a photoreceptor of the present invention, if desired.

[Toner and Developer]

The electrostatic latent image formed on the photoreceptor of the present invention is visualized as a toner image via development. The toner to be used for the development may be crushed toner or polymerized toner, but the toner of the present invention is preferably a polymerized toner prepared by a polymerization method from the viewpoint of realization of a stable particle size distribution.

The polymerized toner means a toner formed via polymerization of raw material monomers for the binder resin, and a physical or chemical treatment conducted later on, if desired.

To be more concrete, the foregoing toner means a toner formed via polymerization reaction such as suspension polymerization, emulsion polymerization or the like, and a particle-to-particle fusing process subsequently carried out, if desired.

In addition, the volume average particle diameter, that is, 50% volume particle diameter (Dv50) is preferably 2-9 μm, and more preferably 3-7 μm. High resolution can be obtained by falling the volume average particle diameter in this range. Further, an existing amount of toner having a fine particle diameter can be reduced in combination with the above-described range, though the toner is one having a small particle diameter, whereby improved dot image reproduction is obtained for a long duration, and stable images exhibiting excellent sensitivity can be formed. The volume average particle diameter of the toner can be measured and calculated by using an apparatus in which a computer system for data processing is connected to typically Multisizer 3 (manufactured by Beckman Coulter Co. Ltd.).

The toner of the present invention may be used as a single component developer or a two-component developer.

When the toner is used as a single component developer, provided is a nonmagnetic single component developer, or a magnetic single component developer containing magnetic particles of approximately 0.1-0.5 μm in size in the toner, and both the nonmagnetic single component developer and the magnetic single component developer are usable.

The toner may be used as a two-component developer by mixing with a carrier. In this case, commonly known materials which are metal such as iron, ferrite, magnetite or the like, an alloy of such the metal and another metal such as aluminum, lead or the like, and so forth are usable as magnetic particles for carrier. Ferrite is specifically preferred. As the carrier, preferred is one in which a magnetic particle is further covered by a resin, or one in which magneric particles are dispersed in a resin, which is a so-called resin-dispersing type carrier. The present invention is not specifically limited to resin compositions for coating, but usable examples thereof include olefin based resin, styrene based resin, styrene-acrylic resin, silicone based resin, ester based resin, fluorine-containing polymer based resin or the like. Further, the present invention is not specifically limited to a resin constituting the resin-dispersing type carrier, and usable example thereof include styrene-acrylic resin, polyester resin, fluorine based resin, phenol resin or the like. The above-described carrier may preferably have a volume average particle diameter of 15-100 μm, and more preferably have a volume average particle diameter of 25-80 μm.

The volume average particle diameter of the carrier can be measured with a laser diffraction system particle size distribution measuring device "HELOS" (manufactured by SYMPAIEC Co.).

[Image Forming Method]

Next, an image forming apparatus used in an image forming method employing a photoreceptor of the present invention will be described.

Figure 5:
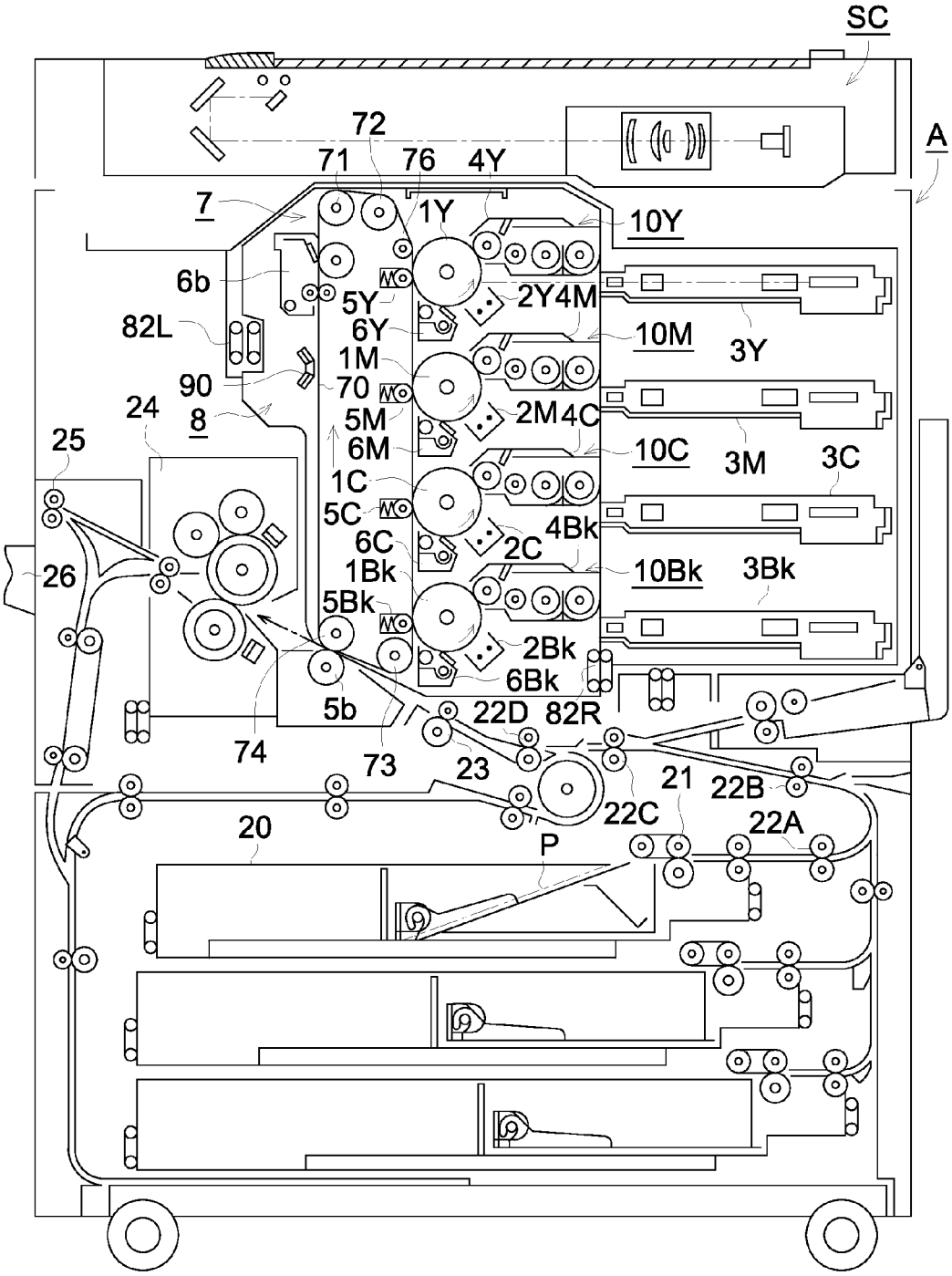
FIG. 5 is a configuration diagram showing a color image forming apparatus equipped with an electrophotographic photoreceptor of the present invention.

FIG. 5 is a cross-sectional diagram of a color image forming apparatus in an embodiment of the present invention.

In an image forming apparatus of the present invention, when an electrostatic latent image is formed on a photoreceptor, a semiconductor laser or a light-emitting diode having an oscillation wavelength of 350-850 nm is used as an image exposure light source. Using such an image exposure light source, a light exposure dot diameter in the primary scanning direction of writing is narrowed to 10-100 μm, and digital light exposure is conducted on an organic photoreceptor to obtain an electrophotographic image at a high resolution of from 600 dpi to 2400 dpi or more (dpi: the number of dots per 2.54 cm).

The light beam to be used includes the beams of the scanning optical system using the semiconductor laser, solid scanner such as an LED and so forth. The distribution of the light intensity includes Gauss distribution and Lorenz distribution, but the portion exceeding $1/e^2$ of each peak intensity is designated as a light exposure dot diameter of the present invention.

This color image forming apparatus is called the so-called tandem type color image forming apparatus, and comprises four sets of image forming sections (image forming units) 10Y, 10M, 10C, and 10Bk, endless belt shaped intermediate transfer member unit 7, sheet feeding and conveyance device 21, and fixing device 24. The original document reading apparatus SC is placed on top of main unit A of the image forming apparatus.

Four sets of image forming units 10Y, 10M, 10C, and 10Bk are constituted, centering on photoreceptor drums 1Y, 1M, 1C, and 1Bk, by rotating charging devices 2Y, 2M, 2C, and 2Bk, image wise light exposure devices 3Y, 3M, 3C, and 3Bk, rotating developing devices 4Y, 4M, 4C, and 4Bk, and cleaning devices 6Y, 6M, 6C, and 6Bk that clean photoreceptor drums 1Y, 1M, 1C, and 1Bk.

Image forming units 10Y, 10M, 10C, and 10Bk, all have the same configuration excepting that the color of the toner image formed in each unit is different on respective photoreceptor drums 1Y, 1M, 1C, and 1Bk, and detailed description is given below taking the example of image forming unit 10Y.

Image forming unit 10Y possesses charging device 2Y, light exposure device 3Y, developing device 4Y, and cleaning device 5Y around photoreceptor drum 1Y as the image forming body to form yellow (Y) colored toner image on photoreceptor drum 1Y. Further, in the present preferred embodiment, at least photoreceptor drum 1Y, charging device 2Y, developing device 4Y, and cleaning device 6Y in image forming unit 10Y are provided in an integral manner.

Charging device 2Y is a device that applies a uniform electrostatic potential to photoreceptor drum 1Y, and a corona discharge type charger is used in the present preferred embodiment.

Imagewise light exposure device 3Y is a device that conducts light exposure, based on an image signal (Yellow), and forms an electrostatic latent image corresponding to the yellow color image. This light exposure device 3Y is one composed of LED arranged in the form of an array in the axis direction of photoreceptor drum 1Y, and an image focusing element, or is a laser optical system.

The image forming apparatus of the present invention may be configured in such a way that the constituents such as the foregoing photoreceptor, a developing device, a cleaning device and so forth are integrally combined to a process cartridge (image forming unit), and this image forming unit may be installed in the apparatus main body as a detachable unit. It is also possible to arrange such a configuration that at least one of the charging device, the imagewise light exposure device, the developing device, the transfer or separation device and the cleaning device is integrally supported with the photoreceptor to form a process cartridge (image forming unit) as a single detachable image forming unit, employing a guide device such as a rail of the apparatus main body.

Intermediate transfer member unit 7 in the form of an endless belt is wound around a plurality of rollers, and has endless belt shaped intermediate transfer member 70 which acts as a second image carrier in the shape of a partially conducting endless belt which is supported in a free manner to rotate.

The images of different colors formed by image forming units 10Y, 10M, 10C, and 10Bk, are successively transferred on to rotating endless belt shaped intermediate transfer member 70 by primary transfer rollers 5Y, 5M, 5C, and 5Bk acting as the primary image transfer section, thereby forming the synthesized color image. Transfer material P as the transfer material stored inside sheet feeding cassette 20 (the supporting body that carries the final fixed image: for example, plain paper, transparent sheet, etc.,) is fed from sheet feeding device 21, pass through a plurality of intermediate rollers 22A, 22B, 22C, and 22D, and resist roller 23, and is transported to secondary transfer roller 5*b* which functions as the secondary image transfer section, and the color image is transferred in one operation of secondary image transfer on to transfer material P. Transfer material P on which the color image has been transferred is subjected to fixing process by fixing device 24, and is gripped by sheet discharge rollers 25 and placed above sheet discharge tray 26 outside the equipment. Here, the transfer supporting body of the toner image formed on the photoreceptor of the intermediate transfer body or of the transfer material, etc. is collectively called a transfer medium.

On the other hand, after the color image is transferred to transfer material P by secondary transfer roller 5*b* functioning as the secondary transfer section, endless belt shaped intermediate transfer member 70 from which transfer material P has been separated due to different radii of curvature is cleaned by cleaning device 6*b* to remove the remaining toner.

During image formation processing, primary transfer roller 5Bk is at all times contacting against photoreceptor 1Bk. Other primary transfer rollers 5Y, 5M, and 5C come into contact with photoreceptors 1Y, 1M, and 1C, respectively, only during color image formation.

Secondary transfer roller 5*b* comes into contact with endless belt shaped intermediate transfer body 70 only when secondary transfer is conducted with transfer material P passing through this.

Further, chassis 8 can be pulled out via supporting rails 82L and 82R from body A of the apparatus.

Chassis 8 possesses image forming sections 10Y, 10M, 10C, and 10Bk, and endless belt shaped intermediate transfer member unit 7.

Image forming sections 10Y, 10M, 10C, and 10Bk are arranged in column in the vertical direction. Endless belt shaped intermediate transfer member unit 7 is placed to the left side in the figure of photoreceptor drums 1Y, 1M, 1C, and 1Bk. Endless belt shaped intermediate transfer member unit 7 possesses endless belt shaped intermediate transfer member 70 that can rotate around rollers 71, 72, 73, 74 and 76, primary image transfer rollers 5Y, 5M, 5C and 5Bk, and cleaning device 6*b*.

The image forming apparatus of the present invention is commonly suitable for electrophotographic apparatuses such as electrophotographic copiers, laser printers, LED printers, liquid crystal shutter type printers and so forth. Further, the image forming apparatus can be widely utilized for apparatuses for displaying, recording, light printing, plate making and facsimile to which an electrophotographic technique is applied.

EXAMPLE

Next, typical embodiments are shown to further describe the present invention, but as a matter of course, the structure of the present invention is not limited thereto.

Example 1

An aluminum alloy drawn tube having a length of 362 mm was placed onto an NC lathe, and subjected to cutting with a diamond sintered tool bit so as to give an outer radius of 59.95 mm, and a surface roughness $Rz_{JIS}$ of 0.75 μm to obtain conductive substrate No. 1.

In this case, starting at the drawn tube end portion, every 2 mm, a tool bit transfer program was set to 300 μm/rev, 310 μm/rev, 320 μm/rev, 310 μm/rev and 300 μm/rev so as to repeatedly increase and decrease.

Similarly, cutting conditions were set to those as shown in Table 2 to prepare conductive substrates Nos. 2-8.

The cutting conditions in this case and results thereof are shown in the following Table 2. The representation in the tool bit transfer program indicates μm/rev (tool bit transfer distance per one revolution of the substrate).

TABLE 2

| *1 | Within or outside the present invention | The number of revolutions (rpm) | Tool bit transfer program [1)] | Autocorrelation coefficient R | | Arithmetic sequence or not | $Rz_{JIS}$ (0.75 ± 0.15 μm) |
|---|---|---|---|---|---|---|---|
| 1 | Within the present invention | 6000 | The following repetition: 300 μm (2 mm) →310 μm (2 mm) →320 μm (2 mm) → 310 μm (2 mm) → | Within the present invention (Large) | 0.70 | No arithmetic sequence | 0.65 |
| 2 | Within the present invention | 6000 | The following repetition: 300 μm (2 mm) →305 μm (2 mm) →310 μm (2 mm) → 315 μm (2 mm) → 320 μm (2 mm) →315 μm (2 mm) → 310 μm (2 mm) → 305 μm (2 mm) → | Within the present invention (Medium) | 0.50 | No arithmetic sequence | 0.77 |
| 3 | Within the present invention | 6000 | The following repetition: 300 μm (2 mm) →305 μm (2 mm) →310 μm (1.5 mm) →315 μm (1 mm)→320 μm (2.5 mm) → 315 μm (2 mm) → 310 μm (1.5 mm) → 305 μm (1 mm) → | Within the present invention (Small) | 0.30 | No arithmetic sequence | 0.66 |
| 4 | Within the present invention | 6000 | The following repetition: 300 μm (2 mm) →320 μm (2 mm) → | Within the present invention (Large) | 0.80 | Arithmetic sequence | 0.74 |
| 5 | Within the present invention | 3000 | The following repetition: 300 μm (2.5 mm) →305 μm (2 mm) →310 μm (1.5 mm) →315 μm (1 mm)→320 μm (2.5 mm) → 315 μm (2 mm) → 310 μm (1.5 mm) → 305 μm (1 mm) → | Within the present invention (Small) | 0.33 | No arithmetic sequence | 0.69 |
| 6 | Outside the present invention | 3000 | The following repetition: 300 μm (2 mm) →320 μm (2 mm) → | Outside the present invention (Excessively large) | 0.85 | Arithmetic sequence | 0.69 |
| 7 | Outside the present invention | 6000 | 310 μm remaining constant | Outside the present invention (Excessively large) | 0.90 | Arithmetic sequence | 0.81 |
| 8 | Outside the present invention | 6000 | The following repetition: 270 μm (2.5 mm) →290 μm (2 mm) →310 μm (1.5 mm) → 330 μm (1 mm)→350 μm (2.5 mm) → 330 μm (2 mm) → 310 μm (1.5 mm) → 290 μm (1 mm) → | Outside the present invention (Excessively small) | 0.25 | No arithmetic sequence | 0.66 |

*1 Conductive substrate No.

1) Processing machine: URL-550EXII, manufactured by EGURO Ltd.

Surface Roughness ($Rz_{JIS}$)

The measurement results (ten-point average roughness of total profile) were obtained under the conditions of a pick-up having a tip of 2 μm (60°), and JIS'01 Standard for roughness measurement with a measured length of 4.0 mm, a cut-off of 0.8 mm (Gaussian) and a measuring speed of 0.06 mm/see, employing SURFCOM 1400D manufactured by Tokyo Seimitsu Co., Ltd.

<Preparation of Photoreceptor>

(Formation of Intermediate Layer)

After one part by weight of binder resin (N–1) was added into 20 parts by weight of ethanol/n-propylalcohol/tetrahydrofuran (45:20:30 in volume ratio), and dissolved while stirring, rutile type titanate oxide particles having been subjected to a surface treatment with 5% by weight of methylhydrogen polysiloxane were mixed to disperse the mixed solution employing a bead mill. In this case, dispersing was carried out using zirconia beads having an average particle diameter of 0.5 mm, a filling ratio of 80%, a peripheral speed of 4 msec, and a mill residence time of 3 hours to prepare an intermediate layer coating solution. After filtering this solution with a polypropylene filter element having a filtration accuracy of 10 μm, the intermediate layer coating solution was coated onto the outer circumference after washing "conductive substrate No. 1" prepared above by an immersion coating method, followed by drying at 120° C. for 20 minutes to form an intermediate layer having a dry thickness of 2 μm.

N-1

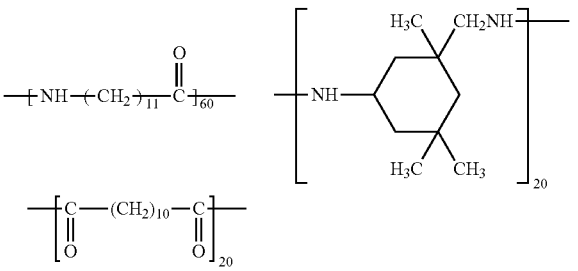

(Formation of Charge Generation Layer)

The following components were mixed and dispersed employing a sand mill dispersing machine to prepare a charge generation layer coating solution. This coating solution was coated on an intermediate layer by an immersion coating method to form a charge generation layer having a thy thickness of 0.3 μm.

| | |
|---|---|
| Y-titanylphthalocyanine {a titanylphthalocyanine pigment having a maximum diffraction peak at a Bragg angle (2θ ± 0.2°) of 27.3° in an X-ray diffraction spectrum with Cu—Kα characteristic X-ray} | 20 parts by weight |
| Polyvinyl butyral (BX-1, produced by Sekisui Chemical Co., Ltd.) | 10 parts by weight |
| Methylethyl ketone | 700 parts by weight |
| Cyclohexanone | 300 parts by weight |

(Formation of Charge Transport Layer)

The following components were mixed and dissolved to prepare a charge transport layer coating solution. This solution was coated on the foregoing charge generation layer by an immersion coating method, followed by drying at 120° for 70 minutes to form "charge transport layer" having a dry thickness of 20 μm.

| | |
|---|---|
| Charge transport layer (having the following structure) | 50 parts by weight |
| Polycarbonate resin "IUPILON-Z300" (produced by Mitsubishi Gas Chemical Company Inc.) | 100 parts by weight |
| Antioxidant (2,6-di-t-butyl-4-methylphenol) | 8 parts by weight |
| Tetrahydrofuran/toluene (8/2 in volume ratio) | 750 parts by weight |

Charge transport material

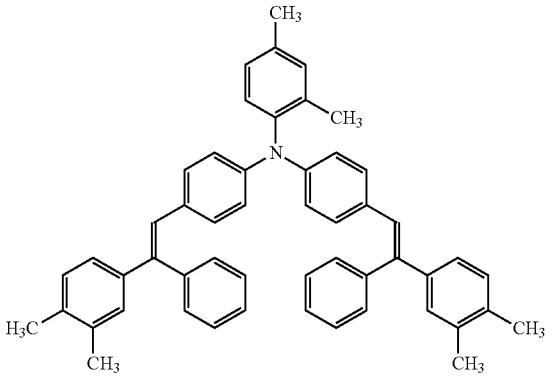

This is designated as photoreceptor No. 1.

Examples 2-5 and Comparative Examples 1-3

Photoreceptors Nos. 2-5 for Examples 2-5 and photoreceptors Nos. 6-8 for Comparative examples 1-3 as shown in Table 3 were prepared using conductive substrates 2-8. In addition, an intermediate layer as well as a photosensitive layer was prepared in the same manner as in preparation of photoreceptor No. 1 for Example 1.

[Performance Evaluation]

Figure 4:
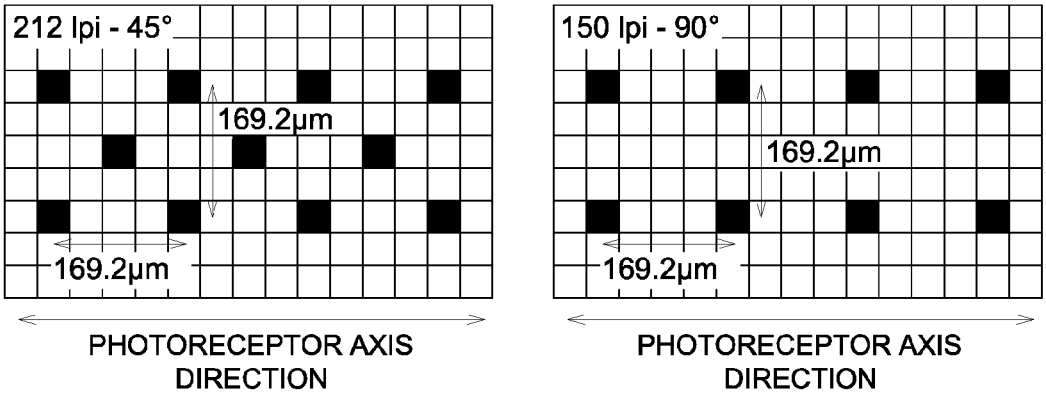
FIG. 4 is an explanatory diagram in which a halftone light exposure pattern is illustrated.

Employing bizhub PRO C6501 manufactured Konica Minolta Business Technologies, Inc. (a copy machine equipped with a laser light source having a wavelength of 780 nm), diagonal streaks on the entire surface caused by interference and image flaws caused by cutting failure were evaluated via visual evaluation of images output by using "POD GLOSS COAT (100 g/m$^2$)" produced by Oji Paper Co., Ltd. for halftone of black (Bk) (light exposure patterns of 212 lpi-45° and 150 lpi-90° shown in FIG. 4, and 17 gradations in density order value of 0/255, 15/255, 31/255, 47/255, 63/255, 79/255, 95/255, 111/255, 127/255, 143/255, 159/255, 175/255, 191/255, 207/255, 223/255, 239/255 and 255/255).

Further, the same photoreceptor was image-evaluated via image visualization of the same image patterns, employing a remodeled copy machine of bizhub PRO C6501 (a copy machine equipped with a LED light source of 1200 dpi, having a wavelength of 680 nm).

(Diagonal Streaks Caused by Interference)

Evaluation results in accordance with the following criterion are shown in Table 3.

A: No diagonal streak is observed at all.

B: Diagonal streaks are slightly observed, but there appears no practical problem.

C: Diagonal streaks are observed, and there appears a practical problem.

(Image Flaw)

Evaluation results in accordance with the following criterion are shown in Table 3.

A: No image defect is observed at all.

B: Image defects are slightly observed, but at a practically available level.

C: Image defects are observed, and at no practically available level.

TABLE 3

| | Photo-receptor No. | bizhub PRO C6501 Diagonal streaks caused by interference 212 lpi - 45° | bizhub PRO C6501 Diagonal streaks caused by interference 150 lpi - 90° | bizhub PRO C6501 Image flaw 212 lpi - 45° | bizhub PRO C6501 (remodeled machine) Diagonal streaks caused by interference 212 lpi - 45° | bizhub PRO C6501 (remodeled machine) Diagonal streaks caused by interference 150 lpi - 90° | bizhub PRO C6501 (remodeled machine) Image flaw 212 lpi - 45° |
|---|---|---|---|---|---|---|---|
| Example 1 | 1 | A | B | A | A | B | A |
| Example 2 | 2 | A | A | A | A | A | A |
| Example 3 | 3 | A | A | A | A | A | A |
| Example 4 | 4 | B | B | A | B | B | A |
| Example 5 | 5 | A | A | A | A | A | A |
| Comparative example 1 | 6 | B | C | A | B | C | A |

TABLE 3-continued

| | Photo-receptor No. | bizhub PRO C6501 Diagonal streaks caused by interference 212 lpi - 45° | bizhub PRO C6501 Diagonal streaks caused by interference 150 lpi - 90° | bizhub PRO C6501 Image flaw 212 lpi - 45° | bizhub PRO C6501 (remodeled machine) Diagonal streaks caused by interference 212 lpi - 45° | bizhub PRO C6501 (remodeled machine) Diagonal streaks caused by interference 150 lpi - 90° | bizhub PRO C6501 (remodeled machine) Image flaw 212 lpi - 45° |
|---|---|---|---|---|---|---|---|
| Comparative example 2 | 7 | C | C | A | C | C | A |
| Comparative example 3 | 8 | A | A | C | A | A | C |

It is to be understood that any of Examples 1-5 within the present invention exhibits no problematic property, but Comparative examples 1-3 outside the present invention produce a problem with respect to any of the properties.

[Effect of the Invention]

In the present invention, reduced can be interferential streaks in a halftone image, which are produced when using a cylindrical photoreceptor conductive substrate having been subjected to tool bit cutting processing, whereby provided can be an electrophotographic photoreceptor capable of obtaining high image quality in response to a light printing field or the like and an image forming method employing the electrophotographic photoreceptor.

What is claimed is:

1. An electrophotographic photoreceptor comprising a cylindrical conductive substrate having been finished via cutting processing while varying a tool bit transfer speed, a number of revolutions of the conductive substrate, or both of them during a single cutting process, and provided thereon, a photosensitive layer, wherein among lag peaks excluding the lag peak of 0 in a correlogram of a surface profile of the substrate in a direction along a central axis of the substrate, the three tallest peaks have a mean value in height of 0.3-0.9, the height expressed as an autocorrelation coefficient, where the correlogram is a correlogram obtained by plotting results from which an autocorrelation coefficient between a base zone of a certain observation result and a target zone having the same number of data as in the base zone is calculated, while displacing the target zone, and lag in the target zone and the autocorrelation coefficient are plotted on a horizontal axis and a vertical axis, respectively; and when there is the same number of two numerical sequence data a correlation coefficient is a value obtained by dividing a mean value of covariance of the two numerical sequence data with the product of each standard deviation, and a correlation coefficient calculated among partial data within certain numerical sequence data is designated as an autocorrelation coefficient.

2. The electrophotographic photoceptor of claim 1, wherein positions R1, R2, R3, - - - of peaks in the correlogram exhibit no arithmetic sequence, where the positions of each peak having 0.3 or more are designated in order from the smallest lag at a first peak position.

3. An image forming method comprising the step of:

exposing the electrophotopraphic photoreceptor of claim 1 to laser light or LED light to form images.

4. An image forming method comprising the step of:

exposing the electrophotographic photoreceptor of claim 2 to laser light or LED light to form images.

5. The electrophotographic photoreceptor of claim 1, wherein the cutting processing is cutting processing while varying a tool bit transfer speed.

* * * * *